US007397331B2

(12) United States Patent
Koizumi et al.

(10) Patent No.: US 7,397,331 B2
(45) Date of Patent: Jul. 8, 2008

(54) COUPLING STRUCTURE, RESONATOR EXCITATION STRUCTURE AND FILTER FOR COPLANAR-WAVEGUIDE CIRCUIT

(75) Inventors: Daisuke Koizumi, Zushi (JP); Kei Satoh, Yokosuka (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 177 days.

(21) Appl. No.: 11/349,775

(22) Filed: Feb. 9, 2006

(65) Prior Publication Data

US 2006/0193559 A1 Aug. 31, 2006

(30) Foreign Application Priority Data

Feb. 9, 2005 (JP) ..... 2005-033336

(51) Int. Cl.
*H01P 3/08* (2006.01)
*H01P 7/08* (2006.01)

(52) U.S. Cl. ..... 333/219; 333/208; 333/204

(58) Field of Classification Search ..... 333/204, 333/205, 208, 209, 219
See application file for complete search history.

(56) References Cited

U.S. PATENT DOCUMENTS 3,451,015 A 6/1969 Heath
3,745,489 A 7/1973 Cristal et al.
6,262,640 B1 * 7/2001 Tsujiguchi ..... 333/204

FOREIGN PATENT DOCUMENTS

EP 0 068 345 A1 1/1983
EP 0 431 234 A1 6/1991
EP 1 562 255 A1 8/2005

OTHER PUBLICATIONS

Ma et al "Low Loss 5GHz Bandpass Filter Using HTS Coplanar Waveguide Quarter Wavelenght Resonator" 2002, IEEE MTT-S Digest, pp. 1967-1970.*
Daisuke Koizumi, et al., "A 5-GHz Band Coplanar-Waveguide High Temperature Superconducting Filter Employing T-Shaped Input/Output Coupling Structure and Quarter-Wavelength Resonator", Technical Report of IEICE, MW 2004-25, May 2004, pp. 55-60.
Tamio Kawaguchi, et al., "Design of a 5GHz Bandpass Filter Using CPW Quarter-Wavelength Spiral Resonators", Proceedings of the 2004 IEICE Society Conference, C-2-81, Figs. 4 (a),(b), Nov. 2004, p. 97.

(Continued)

*Primary Examiner*—Robert J. Pascal
*Assistant Examiner*—Kimberly E Glenn
(74) *Attorney, Agent, or Firm*—Oblon, Spivak, McClelland, Maier & Neustadt, P.C.

(57) ABSTRACT

A coupling structure for coupling to a circuit portion (6) in a coplanar-waveguide circuit (1) having ground conductors (2, 3) at both sides is disclosed. A signal input/output line (4) is provided at the center of the coplanar-waveguide circuit; and an inductive coupling portion (5) having an end of the signal input/output line short-circuited to one of the ground conductors and facing a part of the circuit portion via a first gap is also provided.

7 Claims, 15 Drawing Sheets

OTHER PUBLICATIONS

Tamio Kawaguchi, et al., "Design of a 5GHz Interdigital Bandpass Filter Using CPW Quarter-Wavelength Resonators", Proceedings of the 2004 IEICE Society Conference, C-2-80, Fig. 4, Nov. 2004,p. 96.
Tamio Kawaguchi, et al., "A 5GHz Interdigital Bandpass Filter Using CPW Quarter-Wavelength Resonators", Technical Report of IEICE, MW 2005-2, Apr. 2005, pp. 7-10 (with English Abstract).
Daisuke Koizumi, et al., "Experimental Investigation on a 5-GHz band interdigital bandpass filter using CPW quarter-wavelength resonators", Technical Report of IEICE, MW2005-3, Apr. 2005, pp. 11-14 (with English Abstract).

* cited by examiner

COUPLING STRUCTURE, RESONATOR EXCITATION STRUCTURE AND FILTER FOR COPLANAR-WAVEGUIDE CIRCUIT

BACKGROUND OF THE INVENTION

The present invention generally relates to a coupling structure, a resonator excitation structure and a filter mainly used for microwave or millimeter-wave band coplanar-waveguide circuits.

In the prior art, two kinds of couplings are known as a resonator excitation structure at input/output of coplanar-waveguide circuits such as filters. One is capacitive coupling where an open end of an exciting-line is close to a resonator. The other is inductive coupling where an exciting line is directly connected to a resonator.

FIG. 1 is a plan view of an excitation structure employing a conventional capacitive coupling (See Non-patent Document #1). A coplanar-waveguide circuit 1 includes an exciting line 4 longitudinally running at the center thereof. An end of the exciting line 4 is extended laterally like a T-shape. The T-shape portion of the exciting line 4 faces a T-shape portion of a resonator 6 via a gap to form an excitation portion 5. The sides of the coplanar plane circuit 1 are covered with corresponding ground conductors 2, 3.

FIG. 2 is a plan view of an excitation structure employing a conventional inductive coupling (See Non-patent Document #2). An exciting line 4 is directly connected to a short-circuit portion between an end of a resonator 6 and a ground conductor 3 to form an excitation portion 5.

FIG. 3 is a plan view of an excitation structure employing a conventional inductive coupling (See Non-patent Document #3). An exciting line 4 is directly connected to an end of a resonator 6, and a cross-shape line is connected to ground plates 2, 3 at its corresponding ends to form an excitation portion 5.

[Non-patent Document #1] "A 5 GHz Band Coplanar-Waveguide High Temperature superconducting Filter Employing T-shaped Input/Output Coupling Structure and Quarter-Wavelength Resonator" by Koizumi, Sato, Narahashi, Technical Report of IEICE, MW2004-25, pp. 55-60, May. 2004.

[Non-patent Document #2] "Design of a 5 GHz Bandpass Filter Using CPW Quarter-Wavelength Spiral Resonators" by Kawaguchi, Ma, Kobayashi, Proceedings of the 2004 IEICE Society Conference, C-2-81, November 2004.

[Non-patent Document #3] "Design of a 5 GHz Interdigital Bandpass Filter Using CPW Quarter-Wavelength Resonators" by Kawaguchi, Ma, Kobayashi, Proceedings of the 2004 IEICE Society Conference, C-2-80, November 2004.

The above mentioned conventional excitation structures shown in FIGS. 1~3 have problems discussed below.

In the resonator excitation structure using capacitive coupling as shown in FIG. 1, its external coupling is in general weaker than that in a resonator excitation structure using inductive coupling. When designing bandpass filters using capacitive coupling, in order to obtain a desired external coupling strength, the open end portion of the exciting line must be placed near a portion of the resonator where charges are concentrated. However, if such a charge concentrated portion is not at an outer area, the length of the exciting line must be long enough to ensure a sufficient external coupling strength. That enlarges the excitation structure area of the planar circuit substrate, adversely affects a next stage resonator, and degrades entire circuit characteristics, which are problems.

On the other hand, in a resonator excitation structure using direct connected inductive couplings as shown in FIG. 2 or 3, its external coupling is too strong. Accordingly an exciting line must be directed coupled to the resonator near a short-circuit portion in case of quarter-wavelength resonators, and it is difficult to place the exciting line near the center of plane circuit substrate. When a housing can be considered to be a cut-off waveguide, undesired transmission modes or propagation modes are strongly excited and the circuit characteristics are degraded.

In addition, when adjusting the external coupling strength after manufacturing a planar circuit substrate and circuit pattern, such adjustment also affects the resonant frequency of the resonator. Therefore, it is impossible to independently adjust the external coupling parameter only. As an example explaining this problem, FIG. 4 shows a resonator excitation structure in which an exciting line is directly connected to quarter-wavelength spiral resonator to form inductive coupling. By removing an adjusting portion 7 (indicated by hatched lines) of a ground conductor 2 after manufacturing a circuit pattern, it is possible to increase a gap width g between the ground conductor 2 and a resonator 6 and increase its external Q or weaken external coupling strength. FIG. 5 is a graph showing that the external Q and the resonant frequency of the resonator 6 vary with respect to the gap width g. As clearly shown in FIG. 5, the increase of the gap width g increases not only the external Q but also the resonant frequency of the resonator 6.

Although the above explanation is given about the excitation structure of resonators, these problems may occur at a connecting portion between any circuit portions and signal input/output lines in planar circuits.

SUMMARY OF THE INVENTION

The present invention may provide a coupling structure, a resonator excitation structure and a filter for coplanar-waveguide circuit, in which undesired transmission modes due to signal input/output lines can be suppressed, the coupling area on the coplanar-waveguide circuit substrate is miniaturized, and parameters such as an external Q can be independently adjusted even after manufacturing the circuit pattern.

In a preferred embodiment of the present invention is provided a coupling structure for coupling to a circuit portion (6) in a coplanar plane circuit (1) having ground conductors (2, 3) at both sides, comprising:

a signal input/output line (4) provided at the center of the coplanar-waveguide circuit; and an inductive coupling portion (5) having an end of the signal input/output line short-circuited to one of the ground conductors and facing a part of the circuit portion via a first gap ($\alpha$).

In another embodiment of the present invention is provided a coupling structure for coupling to a circuit portion (6) in a coplanar-waveguide circuit (1) having ground conductors (2, 3) at both sides, comprising:

a signal input/output line (4) provided at the center of the coplanar-waveguide circuit; and a capacitive coupling portion (5) having a surrounding portion (55) at an end of the signal input/output line, the surrounding portion partly surrounding and facing a part of the circuit portion (6) via a first gap.

In further another embodiment of the present invention is provided a resonator excitation structure for exciting a resonator in a coplanar-waveguide-circuit (1) having ground conductors (2, 3) at both sides, comprising:

an exciting line (4) provided at the center of the coplanar-waveguide circuit; and an excitation portion (5) having an end of the exciting line short-circuited to one of the ground conductors and facing a part of the resonator via a first gap (α).

In further another embodiment of the present invention is provided a filter (10) having one or more resonators (6) in a coplanar-waveguide circuit having ground conductors (2, 3) at both sides, comprising:

an exciting line (4) provided at the center of the coplanar-waveguide circuit; and an excitation portion (5) having an end of the exciting line short-circuited to one of the ground conductors and facing a part of the first or last one of the resonators via a first gap (α).

According to the embodiments of the present invention, a coupling structure, a resonator excitation structure and a filter for coplanar-waveguide circuits are provided in which undesired transmission modes due to signal input/output lines can be suppressed, the coupling area on the coplanar-waveguide circuit substrate is miniaturized, parameters such as an external Q can be independently adjusted even after manufacturing the circuit pattern. Especially in microwave or millimeter-wave band coplanar-waveguide circuits housed in a shielded waveguide, it is possible to form a miniaturized excitation structure suppressing undesired transmission modes due to signal input/output lines, and it is possible to adjust an external coupling strength only, without changing other parameters to obtain desired circuit characteristics.

DESCRIPTION OF THE PREFERRED EMBODIMENTS

The following is a description of embodiments of the present invention, with reference to the accompanying drawings.

Throughout all the figures, members and parts having the same or similar functions are assigned the same or similar reference signs, and redundant explanations are omitted.

Figure 6:
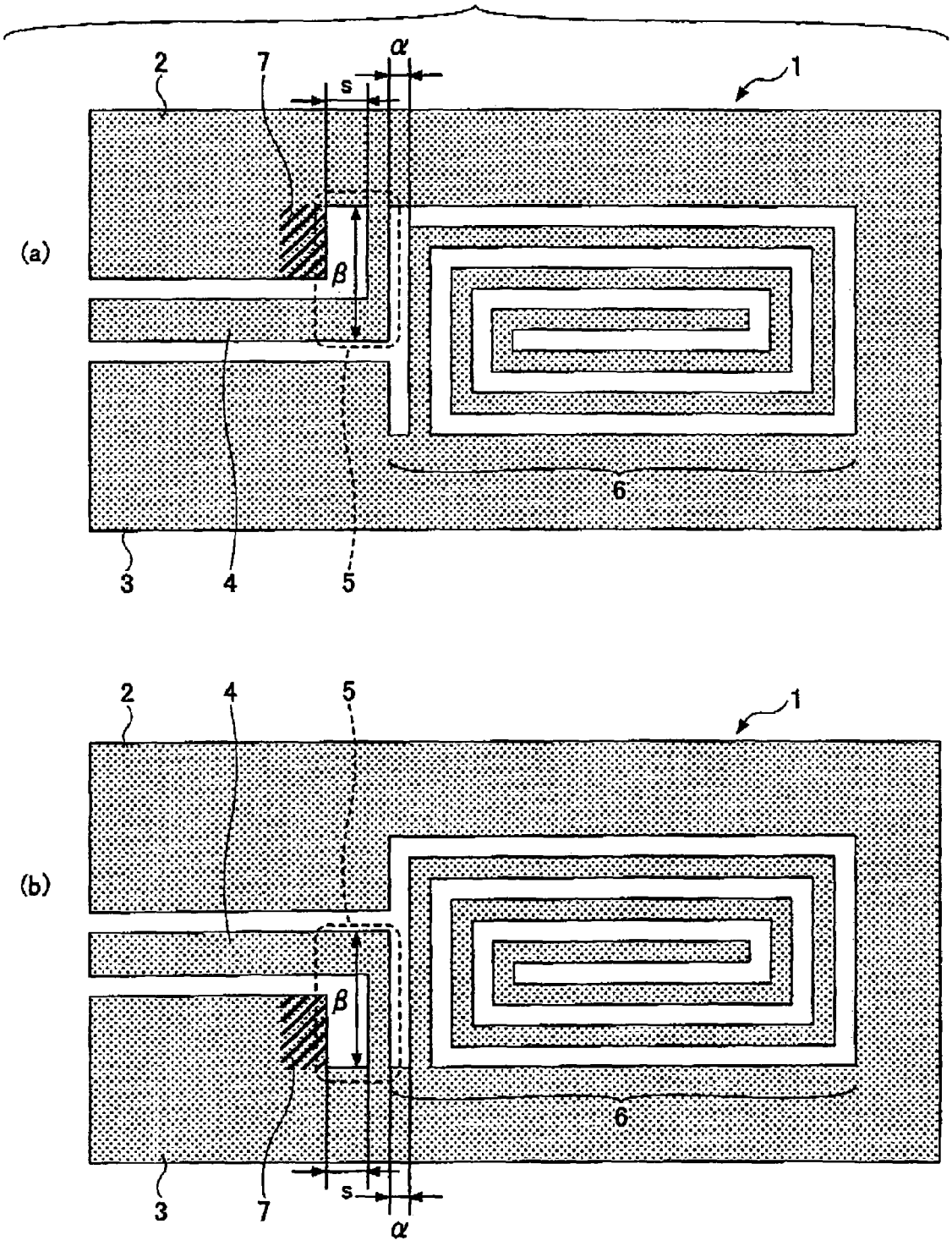
FIG. 6 shows plan views of excitation structures according to a first embodiment of the present invention.

FIG. 6 shows plan views of an excitation structure according to a first embodiment of the present invention. A coplanar-waveguide circuit 1 shown in FIG. 6(*a*) has ground conductors 2, 3 at corresponding sides. An exciting line 4 as a signal input/output line is provided at the central area of the coplanar plane circuit 1 in order not to generate undesired transmission modes or propagation modes in a shielded waveguide housing the circuit substrate. In this embodiment, a circuit to which the exciting line 4 is connected is a quarter-wavelength spiral resonator 6. An end of the exciting line 4 is folded L-shape like and short-circuited to the ground conductor 2 at non-short-circuit side of the resonator 6. This short-circuit line faces a charge concentrated portion of the resonator 6 via a gap having a width α, to form an excitation portion 5 using inductive coupling. A strength of the external coupling is determined by factors such as the gap width α, a length β of the short-circuit line of the exciting line 4, and a distance s between the short-circuit line of the exciting line 4 and the ground conductor 2.

An example shown in FIG. 6(*b*) is different from that in FIG. 6(*a*) in that an end of an exciting line 4 is folded to a short-circuit side of a resonator 6 to form an excitation portion 5.

When it is required to adjust the external coupling strength independently from the resonant frequency of the resonator 6 after manufacturing the circuit pattern, an adjustment portion 7 (indicated by hatched lines) of the ground conductors 2, 3 is removed to widen the distance s between the ground conductor and the short-circuit line. In this manner, the external coupling strength can be weakened.

Figure 7:
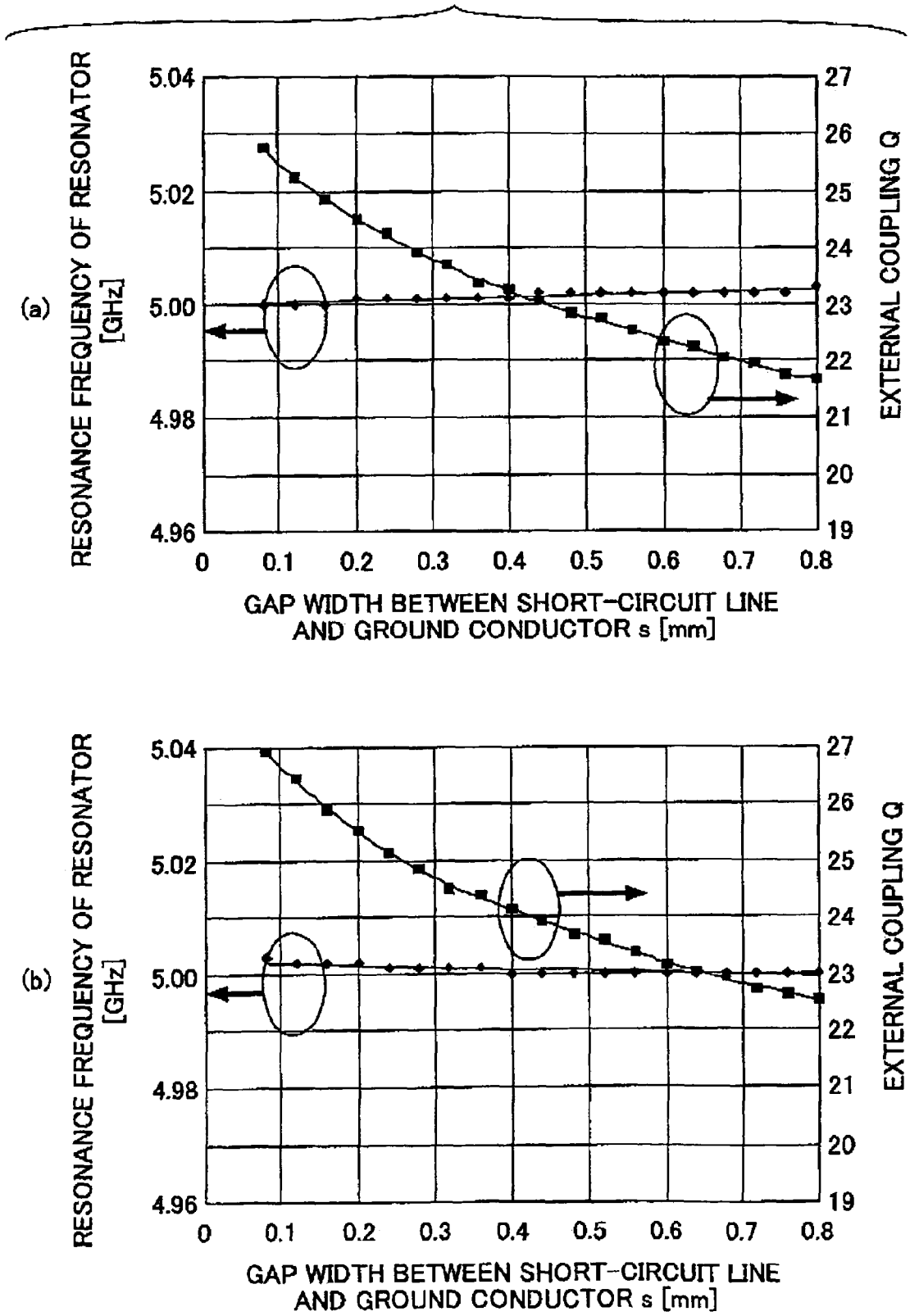
FIG. 7 shows two graphs each showing that the external Q and the resonant frequency of the resonator shown in FIG. 6 vary with respect to the gap width g.

FIGS. 7(*a*), (*b*) are graphs a showing that the external Q and the resonant frequency of the resonators 6 shown in FIGS. 6(*a*), (*b*) respectively vary with respect to the gap width g. As clearly shown in FIGS. 7(*a*), (*b*), the resonant frequency of the resonators 6 does not substantially change due to the variation of the gap width s between the short-circuit line and the ground conductor, which makes the external Q change. In general, the narrower the width of the short-circuit line is, the larger the variation of the external Q becomes. Therefore, the width of the short-circuit line can be adequately designed, in order to obtain a desired variation by removing the ground conductor and widening the gap width s by a certain extent.

Figure 8:
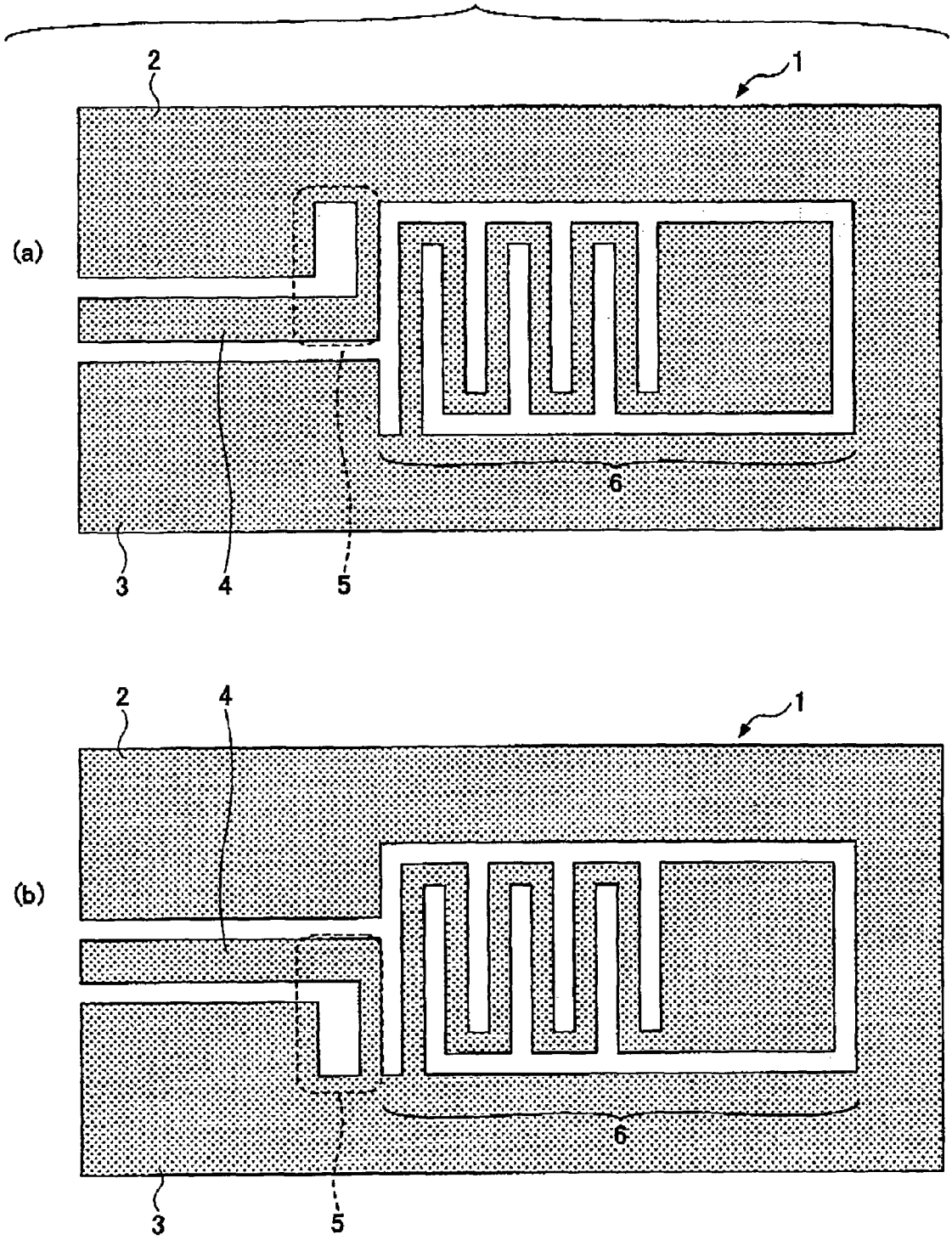
FIG. 8 shows plan views of excitation structures according to a second embodiment of the present invention.

FIG. 8 shows plan views of excitation structures according to a second embodiment of the present invention. Resonators 6 are quarter-wavelength lumped-parameter type meandering resonators. In the resonant excitation structure shown in FIG. 8 (*a*), an end of an exciting line 4 is folded L-shape like and short-circuited to a ground conductor 2 at non-short-circuit side of the resonator 6 to form an excitation portion 5. In the resonant excitation structure shown in FIG. 8 (*b*), an end of an exciting line 4 is folded L-shape like a short-circuited to a ground conductor 3 at a short-circuit side of the resonator 6 to form an excitation portion 5. These structures have the same advantage as the above-explained structures shown in FIGS. 6(*a*), (*b*).

The resonator 6 may be any types of quarter-wavelength resonators, as long as a short-circuit portion thereof is placed close to a short-circuited end of an exciting line 4. In this manner, a variety of excitation structures having the same advantage are obtained, which are all included in the scope of the present invention.

Figure 9:
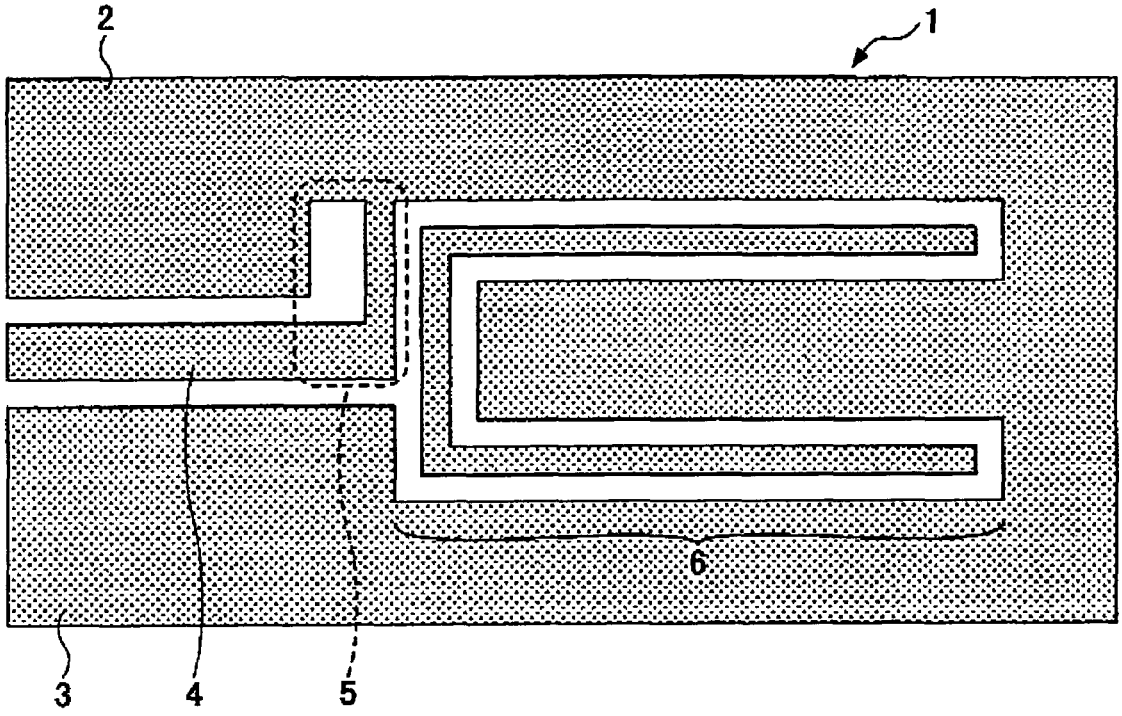
FIG. 9 is a plan view of showing an excitation structure according to a third embodiment of the present invention.

FIG. 9 is a plan view showing an excitation structure according to a third embodiment of the present invention. A resonator 6 is a half-wavelength resonator. The central portion of the resonator 6 where current concentration is highest is placed close to a short-circuited end of an exciting line 4, to form an excitation structure giving the same advantage.

Figure 10:
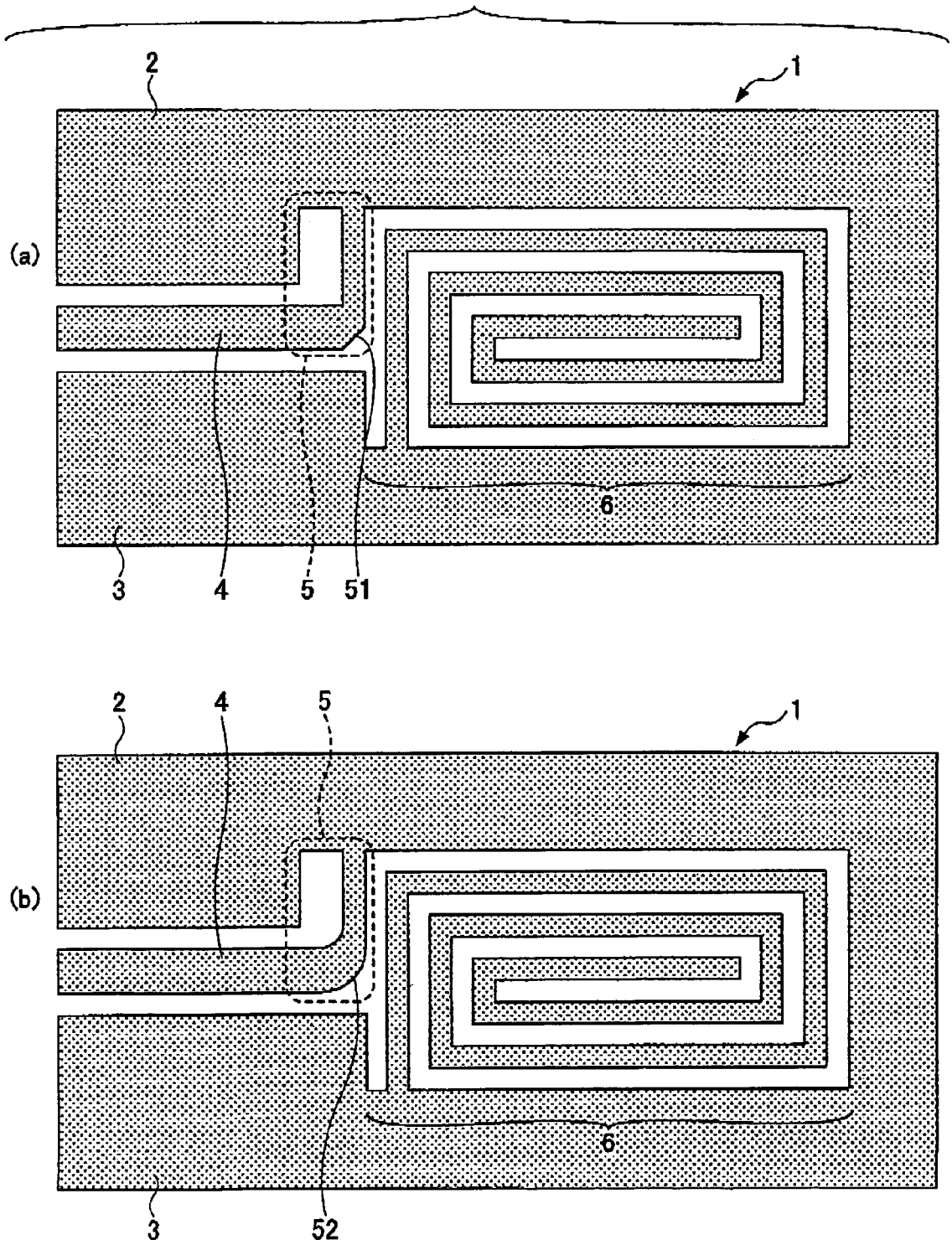
FIG. 10 is a plan view showing excitation structures according to a fourth embodiment of the present invention.

FIG. 10 shows plan views of excitation structures according to a fourth embodiment of the present invention. The excitation structure shown in FIG. 10(*a*) is the same as that shown in FIG. 6(*a*), except that a short-circuit portion of an exciting line 4 has a chamfered or truncated corner 51. The excitation structure shown in FIG. 10(*b*) is the same as that shown in FIG. 6(*a*), except that a short-circuit portion of an exciting line 4 has a rounded corner 52. In these structures, the current concentrating effect by the corners is decreased and lopsided current flows is eliminated, and therefore the circuit characteristics can be improved.

Figure 11:
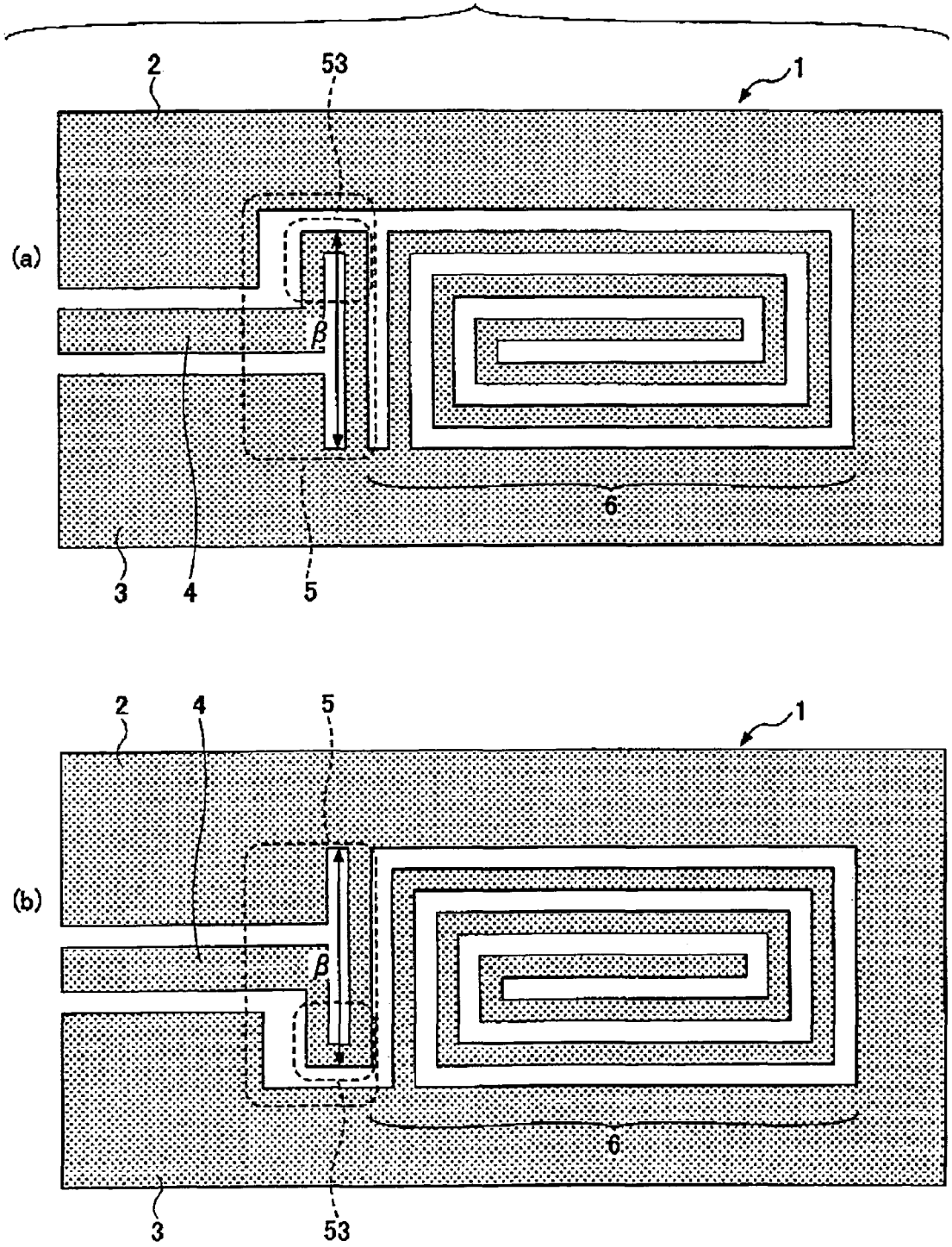
FIG. 11 is a plan view showing excitation structures according to a fifth embodiment of the present invention.

FIG. 11 shows plan views of excitation structures according to a fifth embodiment of the present invention, in which excitation portions 5 are not L-shaped. As shown in FIG. 11(*a*), (*b*), the excitation portions 5 have a folding back portion 53 which extends to the opposite side of a short-circuit portion of an exciting line 4. In these structures, a length β of the excitation portion 5 facing a resonator 6 is long and the coupling between the exciting line 4 and the resonator 6 is strengthened.

Figure 12:
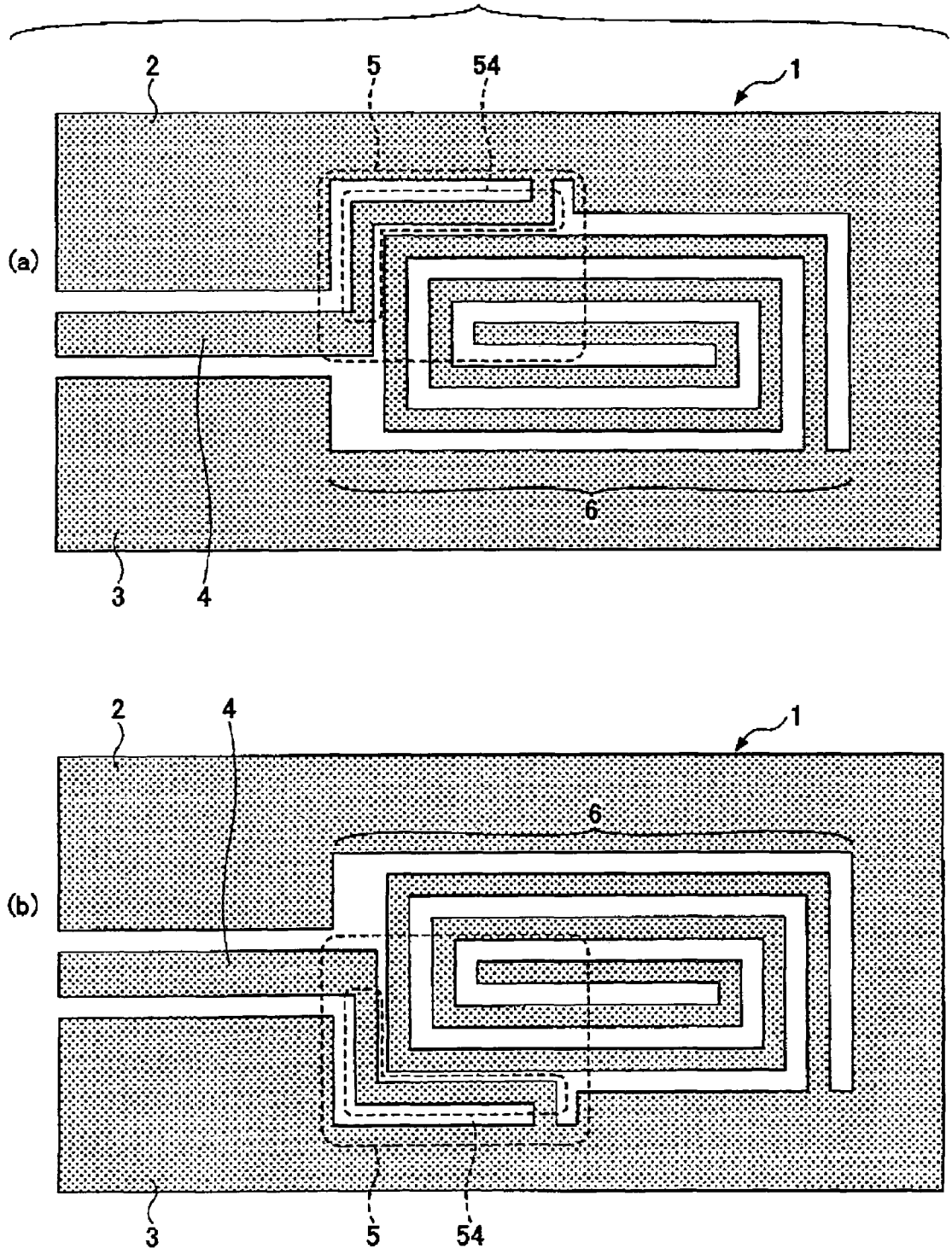
FIG. 12 is a plan view showing excitation structures according to a sixth embodiment of the present invention.

FIG. 12 shows plan views of excitation structures according to a sixth embodiment of the present invention, in which excitation portions 5 are not L-shaped. As shown in FIGS. 12(*a*), (*b*), the excitation portions 5 have a surrounding portion 54 between the folded corner of the excitation portion and a short-circuit portion connected to a ground conductor 2, 3. The surrounding portion 54 partially surrounds a part of a resonator 6 via a gap. In these structures also, the excitation portion 5 facing the resonator 6 is long and the coupling between the exciting line 4 and the resonator 6 is strengthened.

Figure 1:
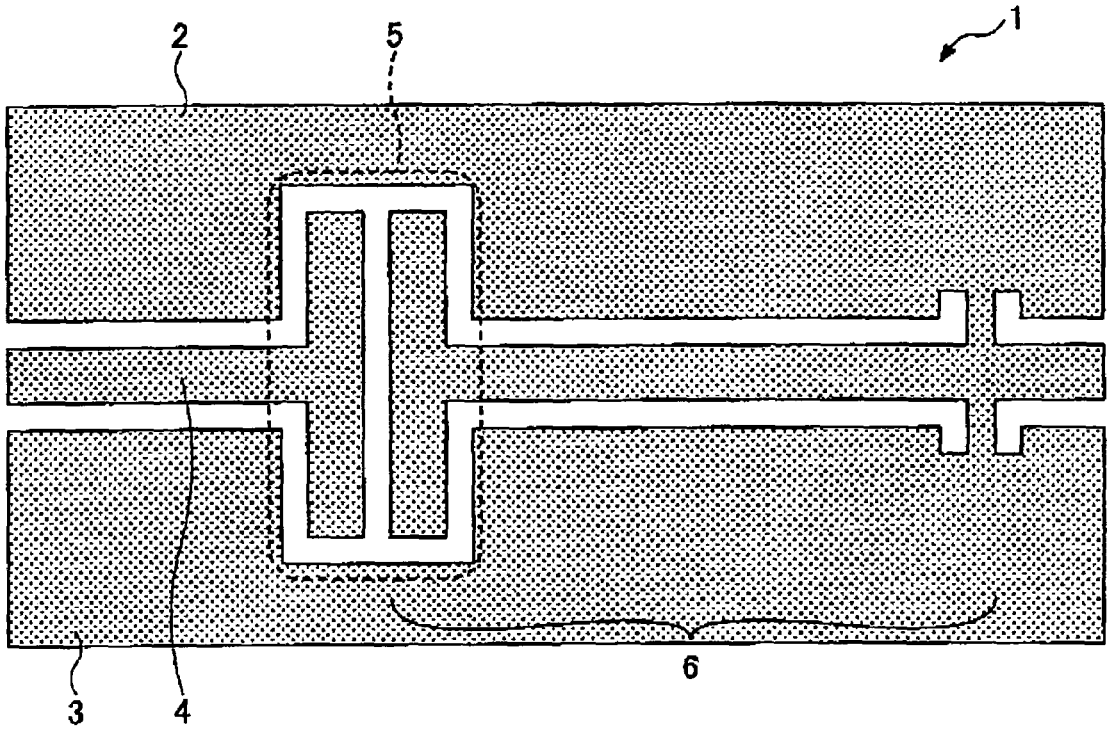
FIG. 1 is a plan view of an excitation structure employing a conventional capacitive coupling.
Figure 2:
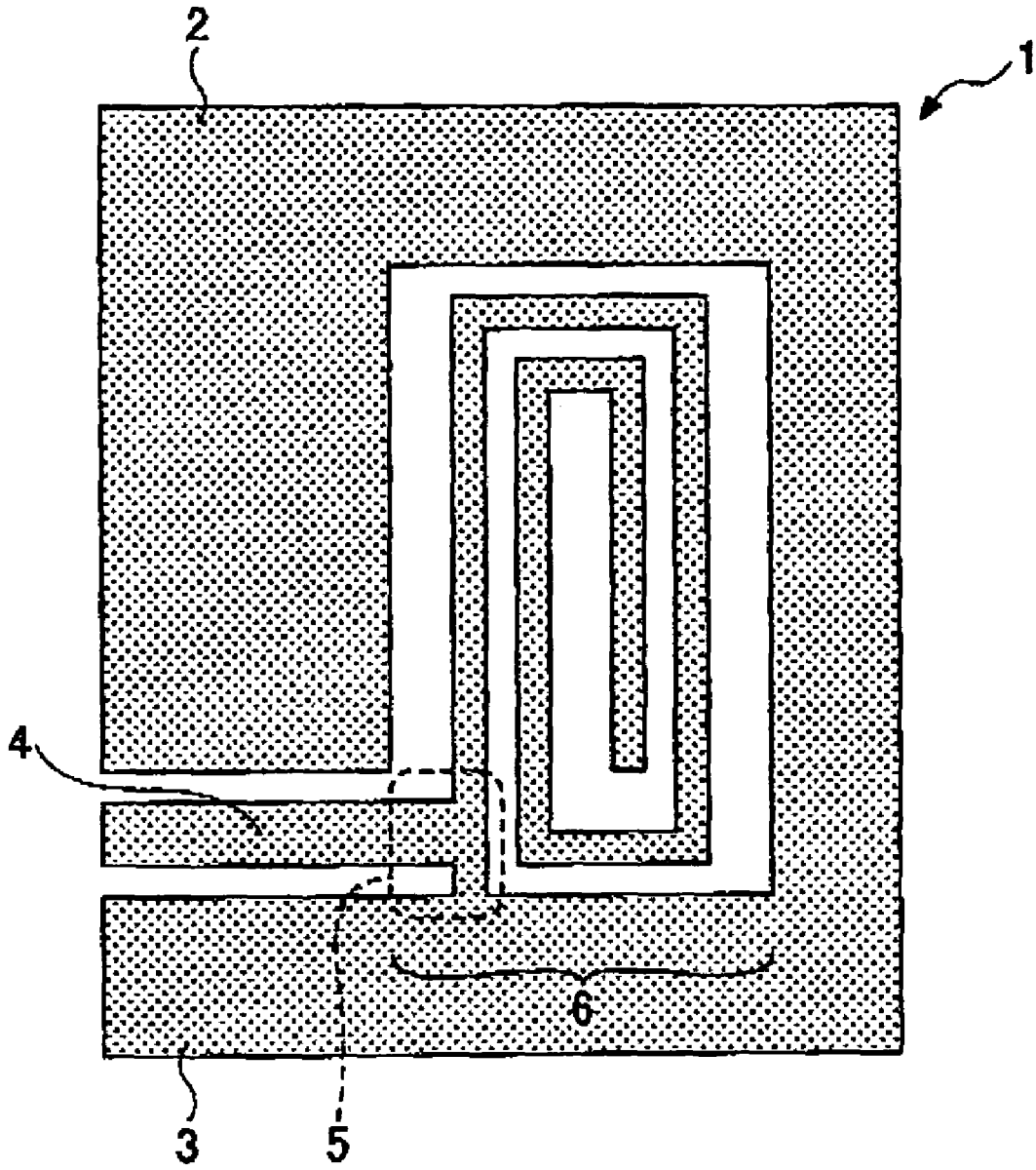
FIG. 2 is a plan view of an excitation structure employing a conventional inductive coupling.
Figure 3:
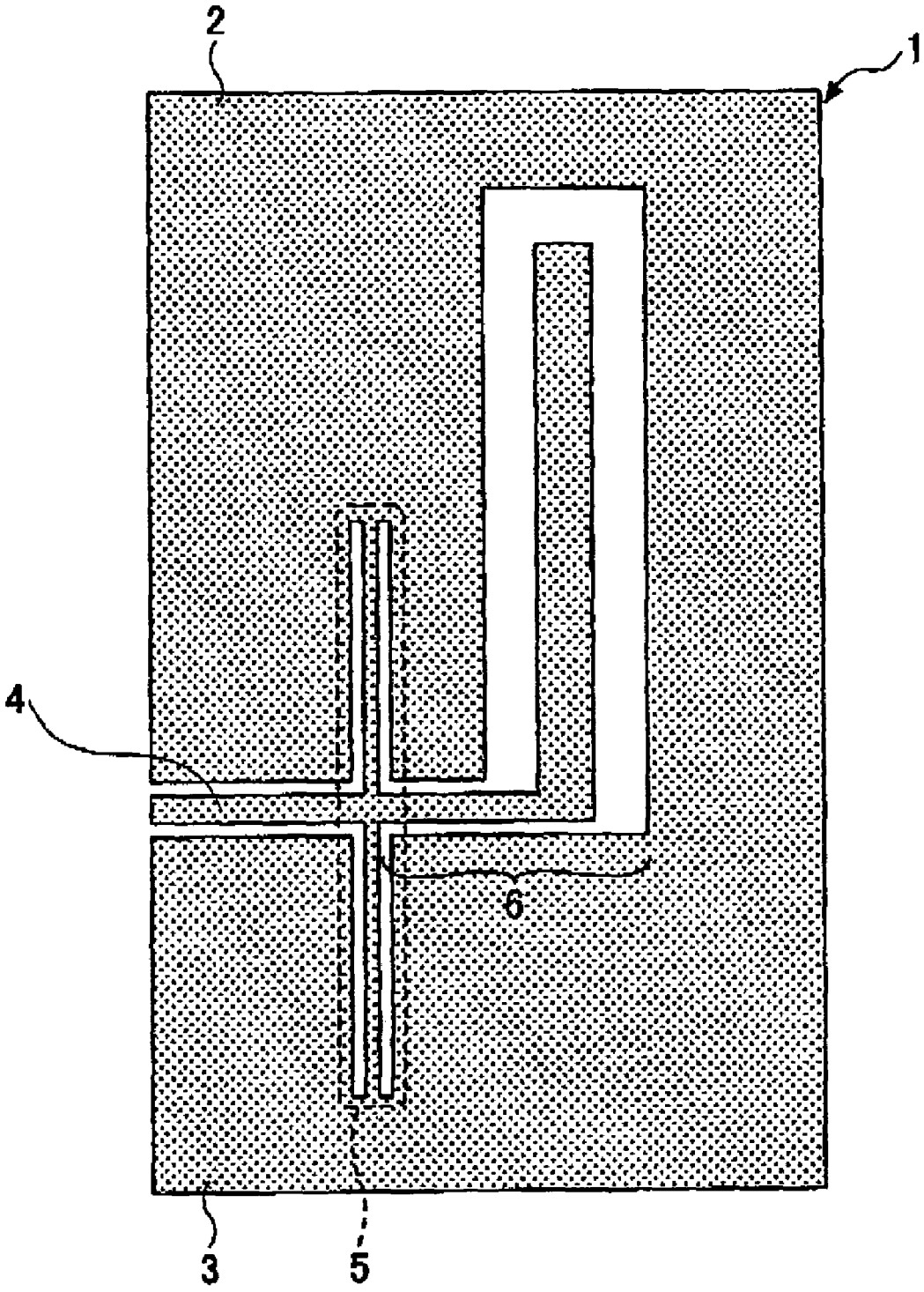
FIG. 3 is a plan view of an excitation structure employing a conventional inductive coupling.
Figure 4:
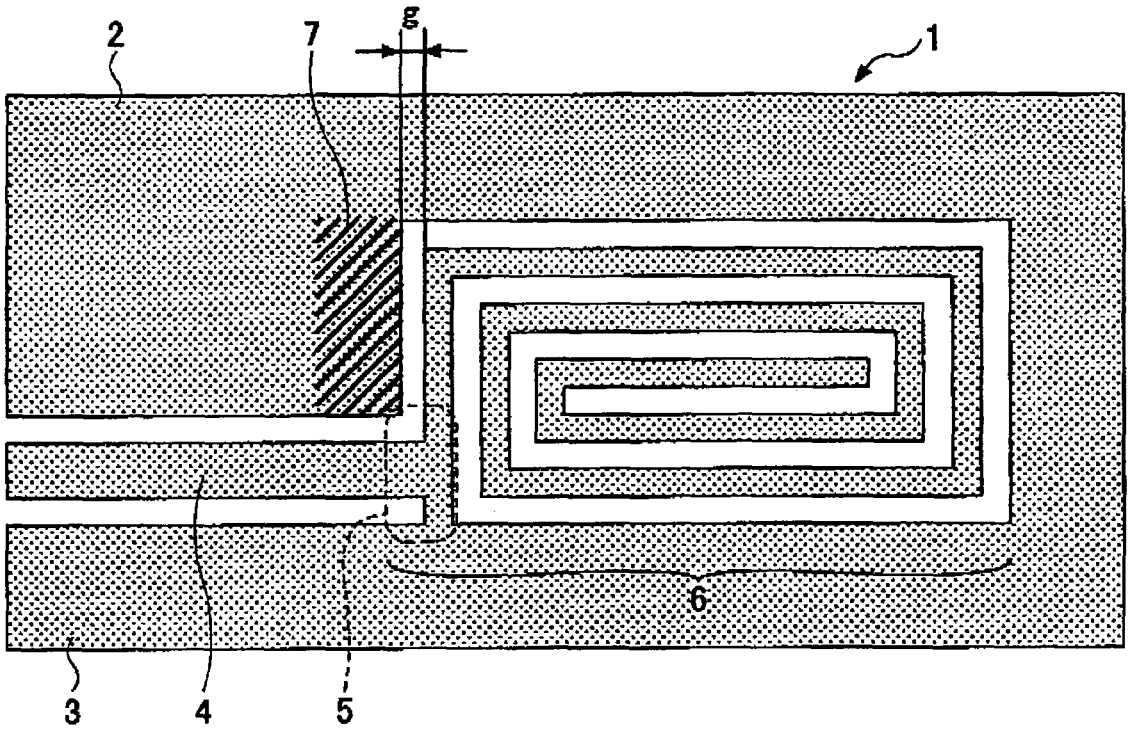
FIG. 4 shows an adjustment method in a resonator excitation structure with a conventional inductive coupling.
Figure 5:
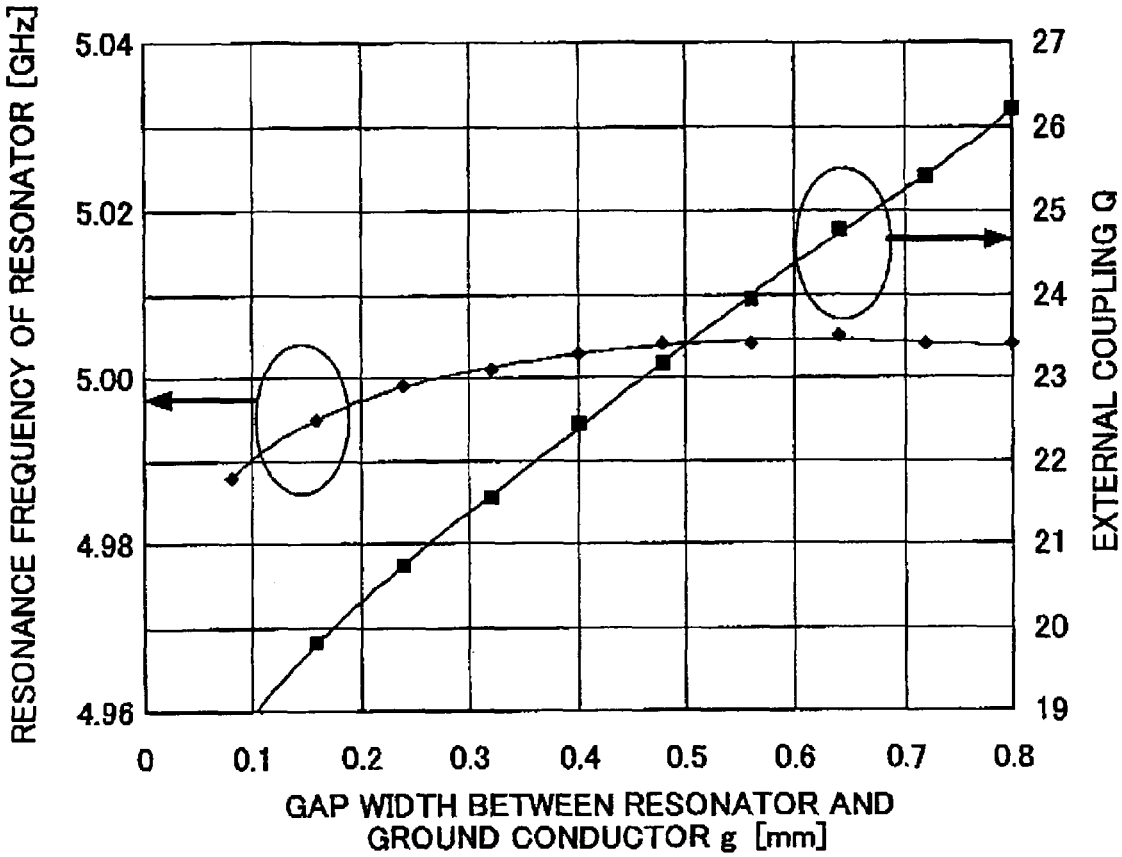
FIG. 5 is a graph showing that the external Q and the resonant frequency of the resonator shown in FIG. 4 vary with respect to the gap width g.
Figure 13:
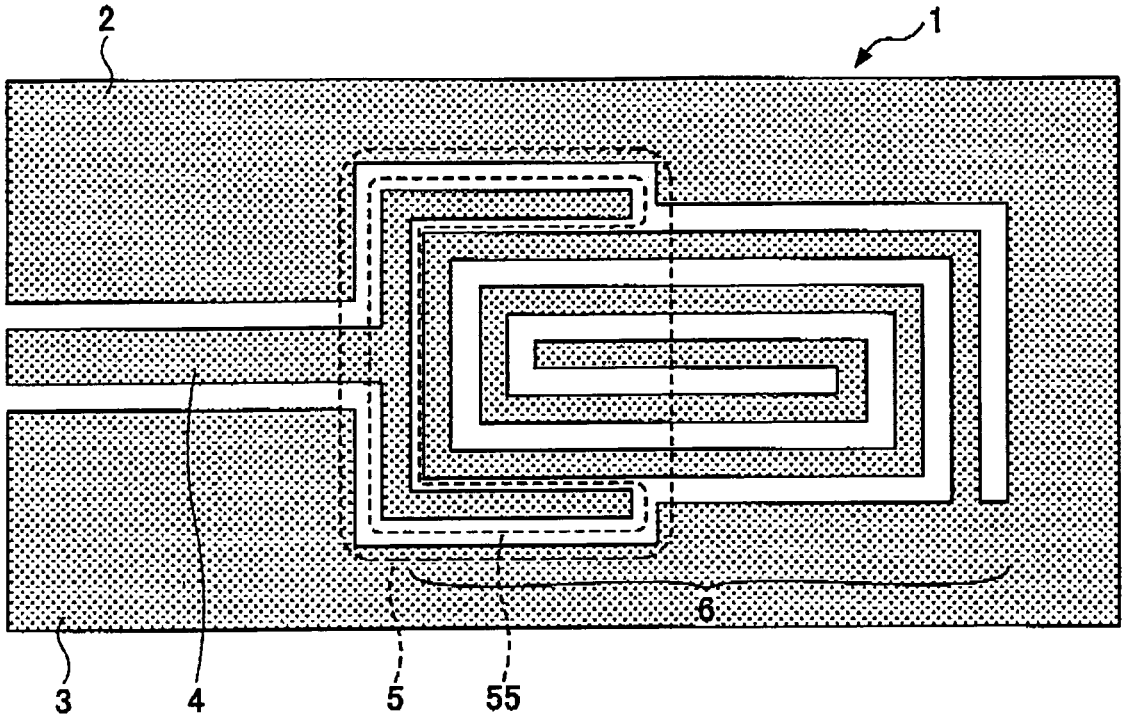
FIG. 13 is a plan view showing excitation structures according to a seventh embodiment of the present invention.

FIG. 13 is a plan view showing an excitation structure according to a seventh embodiment of the present invention. This embodiment is different from the first-sixth embodiments in that an excitation portion 5 employs capacitive coupling instead of inductive coupling. The excitation portion 5 has a surrounding portion 55, which partially surrounds a part of a resonator 6 via a gap. The surrounding portion 55 has open ends. In this case also, since an exciting line 4 is provided at the center of a coplanar-waveguide circuit 1, undesired transmission modes due to the exciting line 4 can be suppressed. Although the resonator 6 uses capacitive coupling, the excitation area on the coplanar-waveguide circuit 1 can be smaller by making the facing portion longer by means of the surrounding structure. Therefore, the circuit can be miniaturized, compared with FIG. 1. The resonator 6 can be separated and independent due to the existence of the surrounding portion 55, and it is easy to independently adjust an external coupling strength.

Figure 14:
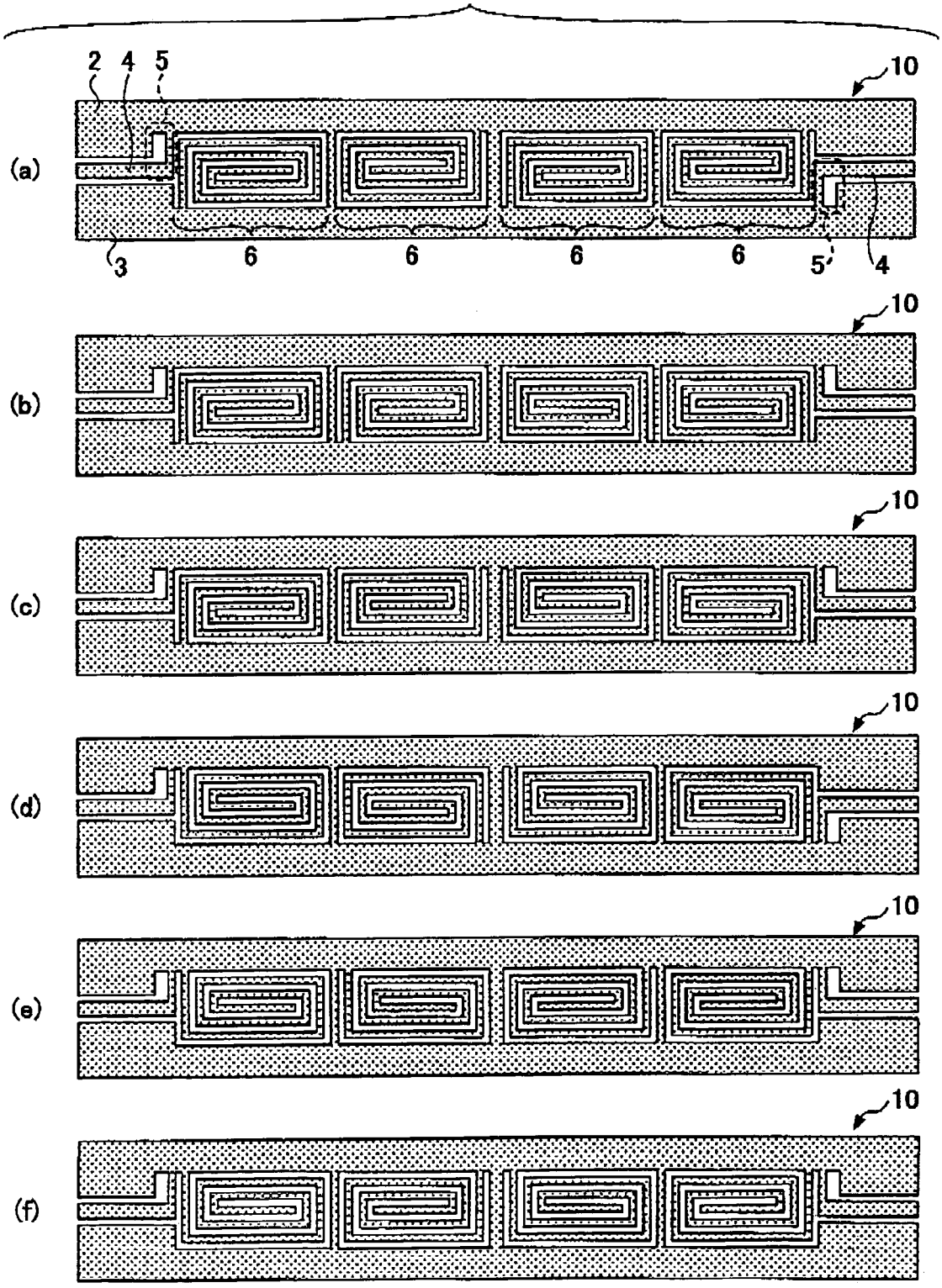
FIG. 14 is a plan view showing excitation structures according to an eighth embodiment of the present invention.

FIG. 14 shows plan views of filters 10 according to an eighth embodiment of the present invention. The filters 10 are four-pole bandpass filters having resonator exciting structures and four resonators (quarter-wavelength spiral resonator). In the resonator exciting structure, an each end of exciting lines 4 is folded L-shape like and short-circuited to a ground conductor to form an excitation portion 5. The structures shown in FIGS. 14(*a*)~(*f*) have a variety of combinations of configurations of the excitation portion 5 and coupling methods between resonators 6.

Figure 15:
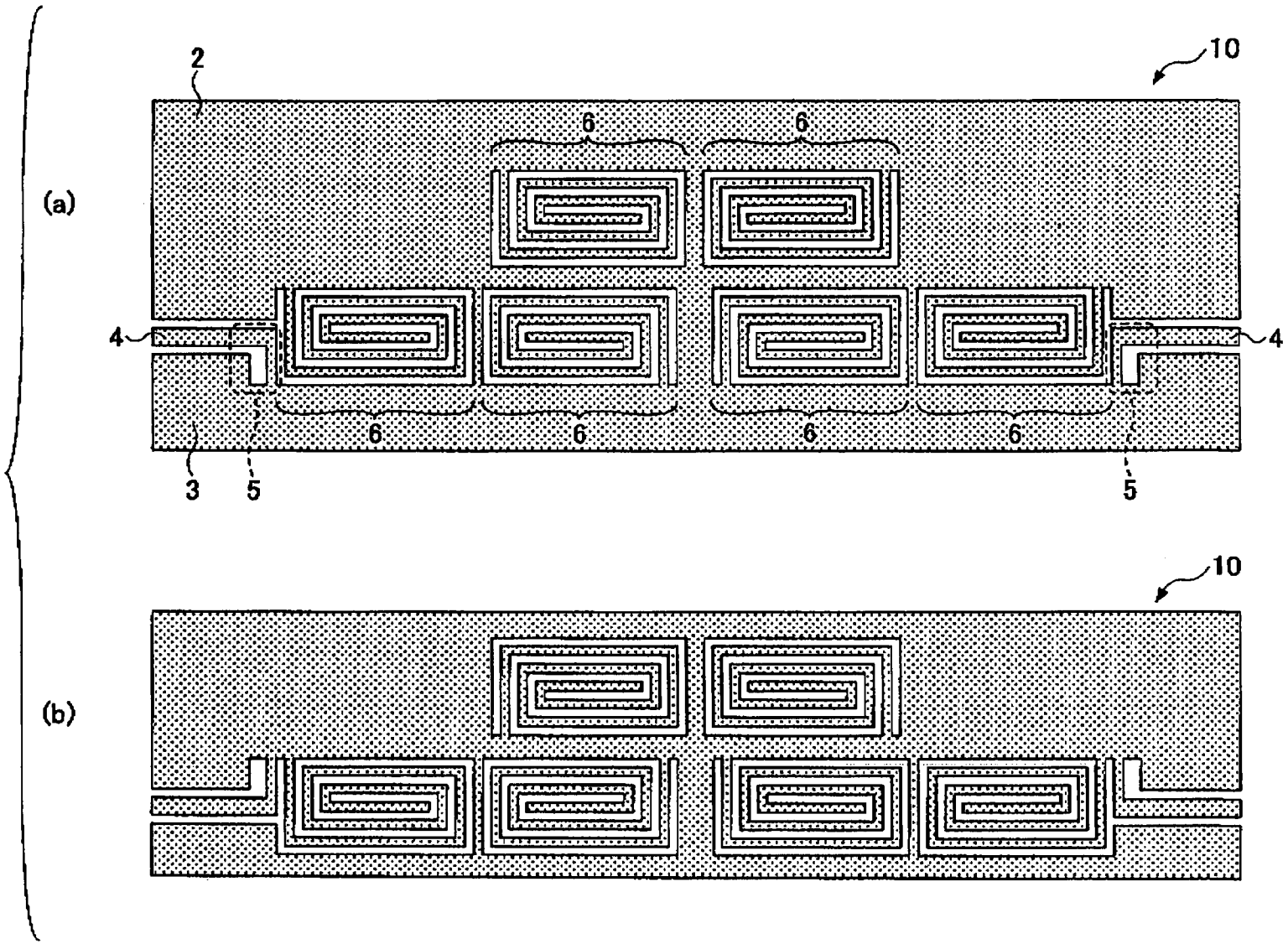
FIG. 15 is a plan view showing excitation structures according to a ninth embodiment of the present invention.

FIG. 15 is a plan view showing filters 10 according to a ninth embodiment of the present invention. The filters 10 may be a six-pole quasi-elliptic bandpass filter having exciting lines 4 and six resonators 6 (quarter-wavelength spiral resonator). An each end of exciting lines 4 is folded L-shape like and short-circuited to a ground conductor to form an excitation portion 5. The structures shown in FIGS. 15(*a*), (*b*) have a variety of combinations of configurations of the excitation portion 5 and coupling methods between resonators 6.

The resonator excitation structures of the bandpass filters shown in FIGS. 14 and 15 are the same as that shown in FIG. 6, and the resonator 6 is a quarter-wavelength spiral resonator. However, the resonator excitation structure may be the types shown in FIGS. 10~13, and the resonator 6 may be another type such as a quarter-wavelength lumped parameter type meandering resonator, a half-wavelength resonator or other resonator get the same characteristics. These structures are all included in the scope of the present invention. There are may combinations of the number of resonators and their coupling methods, and they are all included in the scope of the present invention.

The present application is based on Japanese Priority Application No. 2005-033336 filed on. Feb. 9, 2005 with the Japanese Patent Office, the entire contents of which are hereby incorporated by reference.

What is claimed is:

1. A coupling structure for coupling to a circuit portion in a coplanar-waveguide circuit having ground conductors at both sides, comprising:

a signal input/output line provided at the center of the coplanar-waveguide circuit;

an inductive coupling portion having an end of the signal input/output line short-circuited to one of the ground conductors and facing a part of the circuit portion via a first gap; and a second gap between a part of the ground conductor and the end of the signal input/output line at the opposite side from the circuit portion, wherein the part of the ground conductor is removed to widen the second gap and adjust an external coupling strength.

2. The coupling structure in the coplanar-waveguide circuit as claimed in claim 1, wherein:

the inductive coupling portion is formed by folding the end of the signal input/output line to connect the end to the one of the ground conductors.

3. The coupling structure in the coplanar-waveguide circuit as claimed in claim 2, wherein:

a corner of the folded portion of the inductive coupling portion is chamfered or rounded.

4. The coupling structure in the coplanar-waveguide circuit as claimed in claim 2, wherein:

the folded portion includes a folded-back portion extending in the opposite direction from the short-circuited portion.

5. The coupling structure in the coplanar-waveguide circuit as claimed in claim 2, further comprising:

a surrounding portion between the folded portion and the short-circuited portion of the inductive coupling portion, the surrounding portion partly surrounding a part of the circuit portion.

6. The coupling structure in the coplanar-waveguide circuit as claimed in claim 1, wherein:

the circuit portion includes one of a quarter-wavelength spiral resonator, a quarter-wavelength lumped-parameter type meander resonator and a half-wavelength resonator.

7. A filter having one or more resonators in a coplanar-waveguide circuit having ground conductors at both sides, comprising:

an exciting line provided at the center of the coplanar-waveguide circuit; and an excitation portion having an end of the exciting line short-circuited to one of the ground conductors and facing a part of the first or last one of the resonators via a first gap, and a second gap between a part of the ground conductor and the end of the exciting line at the opposite side from the resonators, wherein the part of the ground conductor is removed to widen the second gap and adjust an external coupling strength.

* * * * *